United States Patent [19]

Richardson et al.

[11] Patent Number: 4,948,464

[45] Date of Patent: Aug. 14, 1990

[54] ACRYLAMIDE-2-ACRYLAMIDO-2-METHYLPROPANESULFONIC ACID POLYMERS AS FORMATION AIDS IN WET LAID NONWOVENS PRODUCTION

[75] Inventors: Paul F. Richardson, Glen Ellyn; Suzanne N. Dunn, Naperville; John A. Romberger, Oak Park, all of Ill.

[73] Assignee: Nalco Chemical Company, Naperville, Ill.

[21] Appl. No.: 402,417

[22] Filed: Sep. 5, 1989

[51] Int. Cl.[5] ..... D21H 13/10; D21H 17/42

[52] U.S. Cl. ..... 162/157.1; 162/157.2; 162/157.3; 162/168.3

[58] Field of Search ..... 162/157.1, 157.2, 168.3, 162/146, 157.3

[56] References Cited

U.S. PATENT DOCUMENTS

| | | | |
|---|---|---|---|
| Re. 28,474 | 7/1974 | Anderson et al. | 260/29.6 H |
| 3,093,534 | 6/1963 | Filing | 162/168.1 |
| 3,284,393 | 11/1966 | Vanderhoff et al. | 260/29.6 |
| 3,725,195 | 4/1973 | Suyama et al. | 162/180 |
| 3,772,142 | 11/1973 | Doggett et al. | 162/168.3 |

*Primary Examiner*—Peter Chin

*Attorney, Agent, or Firm*—Donald G. Epple; Anthony L. Cupoli

[57] ABSTRACT

An aqueous slurry of comprising a plurality of synthetic fibers and from 0.1–10 percent by weight based on the weight of the fibers of a water-soluble acrylamide polymer dispersant containg at least 5 percent by weight of 2-acrylamido-2-methylpropanesulfonic acid units, said polymer having an RSV of at least 10.

2 Claims, 1 Drawing Sheet

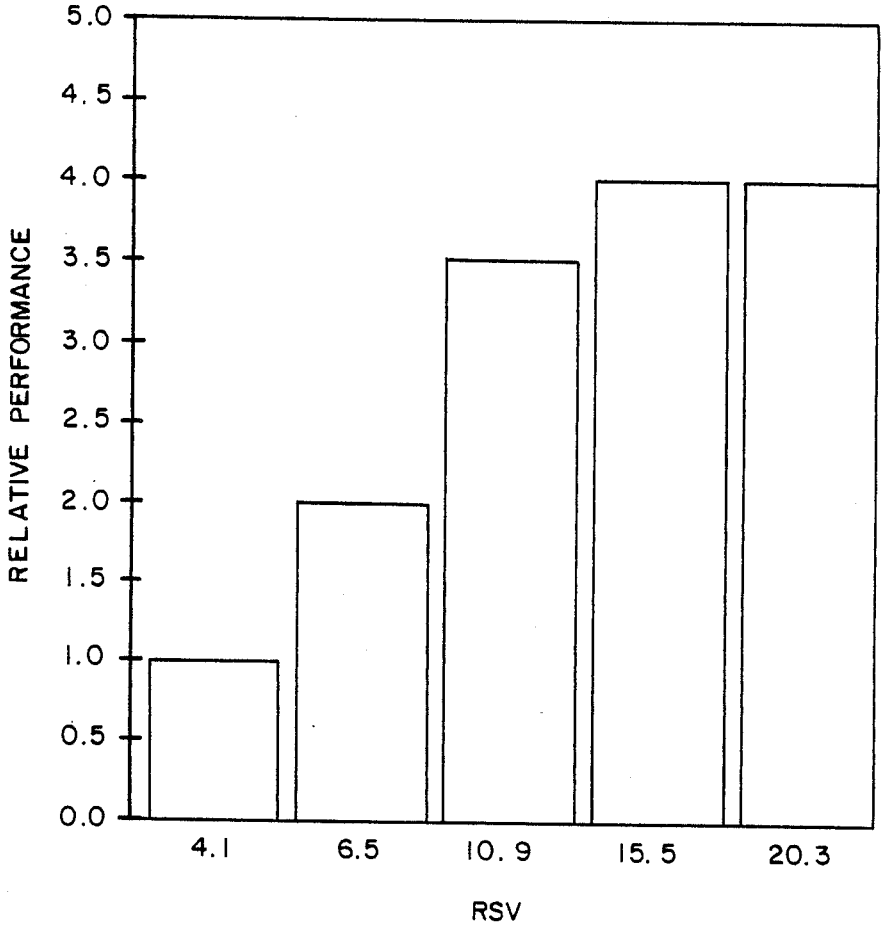
EFFECT OF POLYMER MOLECULAR WEIGHT ON PERFORMANCE

ACRYLAMIDE-2-ACRYLAMIDO-2-METHYLPROPANESULFONIC ACID POLYMERS AS FORMATION AIDS IN WET LAID NONWOVENS PRODUCTION

INTRODUCTION

In the preparation, handling and forming of long fiber slurries, there is a tendency for the fibers in the aqueous slurry to become entangled or agglomerated, impairing the uniformity of the final sheet. To avoid this problem, a formation aid is often added to the slurry to keep the fibers separated.

Useful formation aids for preparing nonwoven stock are the water-soluble acrylamide polymers which contain at least 5% of 2-acrylamido-2-methylpropanesulfonic acid hereafter referred to as AMPS. These polymers have RSV's below 10. The disclosure of U.S. No. 3,772,142 is incorporated herein by reference.

THE DRAWING

The drawing depicts the effect of RSV on the dispersancy of the polymers of this invention on polyester fibers.

THE INVENTION

The invention comprises an aqueous slurry comprising a plurality of synthetic fibers and from 0.1–10 percent by weight based on the weight of the fibers of a water-soluble acrylamide polymer dispersant containing at least 5 percent by weight of AMPS units, said polymer having an RSV of at least 10.

THE POLYMERS

The acrylamide AMPS polymers used in the method of this invention contain at least about 5 percent of AMPS. Good results are achieved using polymers containing 10–20 percent by weight of AMPS.

METHOD OF POLYMER PREPARATION

As indicated, the polymers of the invention have RSV, (Reduced Specific Viscosities) of at least 10. RSV's ranging between 10–20 or more are preferred. For purposes of this invention, RSV is defined to be the Reduced Specific Viscosity of a polymer measured at 0.045 grams of polymers per 100 grams of an aqueous sodium nitrate solution measured at 25° C.

To achieve these RSV's, a preferred method of preparing the acrylamide copolymers is to employ the inverse polymerization technique which produces latex or water-in-oil emulsion polymers. This method is described in U.S. Pat. Nos. Re. 28,474 and 3,284,393. The disclosures of which are incorporated herein by reference.

THE SYNTHETIC FIBERS

Typical synthetic fibers include rayon, polyamide, glass, polyester and polyolefins. Depending on the type of stock being prepared, these fibers may be admixed with various non-fibrous materials.

The invention is particularly adapted to dispersing polyester and glass fibers.

DOSAGE

The amount of acrylamide AMPS polymer used in the method of this invention is generally about 0.1–10 percent by weight, based on the weight of fibrous material in the slurry. About 1–5 percent is preferred.

EVALUATION OF THE INVENTION

A series of acrylamide/Na AMPS copolymers were synthesized for formation aid testing. These polymers contain 11 mole % AMPS with varying RSVs.

The polymers were evaluated for formation aid activity using the Noble and Wood handsheet mold. ¾"×1.5 DPF polyester fibers were used for the testing.

Procedure: 2 liters water mixed with 3 blade stirrer. Add 0.3 ml polyester dispersant plus formation aid. Add 2 g fibers, mix 20 minutes. Pour into handsheet mold, agitate 3 times and drain.

A formation aid is required for the ¾" fibers mainly because of the formation of "strings" of intertwined fibers. Addition of a viscosity modifier ("formation aid") tends to reduce the number of strings in the sheet. The purpose of this experiment was to determine differences in formation aid activity for a series of polymers with the same chemistry but different RSV.

The following series of handsheets were made:

| Sheet | #Dispersant | RSV | Formation Aid Dose | Rating* |
|---|---|---|---|---|
| 1 | — | — | — | 1— |
| 2 | 0.3 ml | — | — | 1 |
| 3 | 0.3 ml | 19 | 50 ml, 0.3% Solution | 4<br>4 |
| 4 | 0.3 ml | 20.3 | 50 ml, 0.3% Solution | 4 |
| 5 | 0.3 ml | 15.5 | 50 ml, 0.3% Solution | 4 |
| 6 | 0.3 ml | 10.9 | 50 ml, 0.3% Solution | 3.5 |
| 7 | 0.3 ml | 6.5 | 50 ml, 0.3% Solution | 2 |
| 8 | 0.3 ml | 4.1 | 50 ml, 0.3% Solution | 1 |

*Sheet Rating - Note: Sheets are rated subjectively for number of "strings" of intertwined fibers and overall formation. For these sheets string formation was the major factor in rating sheets. 1 = poor, 5 = good.

This handsheet testing showed a clear relationship between RSV and performance. Starting with the 10.9 RSV polymer formation aid, performance dropped off rapidly with decreasing RSV. The sheet made with the 4.1 RSV polymer was indistinguishable from a sheet made with no formation aid (only dispersant).

We claim:

1. An aqueous slurry comprising a plurality of synthetic fibers and from 0.1–10 percent by weight based on the weight of the fibers of a water-soluble acrylamide polymer dispersant containing at least 5 percent by weight of 2-acrylamido-2-methylpropanesulfonic acid units, said polymer having an RSV of at least 10.

2. The aqueous slurry of claim 1 where the synthetic fibers are polyester fibers and the water-soluble acrylamide polymer contains from 10–20% 2-acrylamido-2-methylpropanesulfonic acid.

* * * * *